US011399602B1

(12) United States Patent
Ciatto Corso

(10) Patent No.: US 11,399,602 B1
(45) Date of Patent: Aug. 2, 2022

(54) EARRING BACK SUPPORTER WITH ADDITIONAL ORNAMENT

(71) Applicant: Carmela Max Ciatto Corso, Rehoboth, MA (US)

(72) Inventor: Carmela Max Ciatto Corso, Rehoboth, MA (US)

( * ) Notice: Subject to any disclaimer, the term of this patent is extended or adjusted under 35 U.S.C. 154(b) by 0 days.

(21) Appl. No.: 17/675,178

(22) Filed: Feb. 18, 2022

Related U.S. Application Data

(60) Provisional application No. 63/207,322, filed on Feb. 23, 2021.

(51) Int. Cl.
*A44C 7/00* (2006.01)

(52) U.S. Cl.
CPC ..... *A44C 7/003* (2013.01)

(58) Field of Classification Search
CPC ..... A44C 7/002; A44C 7/003; A44C 7/004; A44C 7/005; A44C 7/009
See application file for complete search history.

(56) References Cited

U.S. PATENT DOCUMENTS 1,602,239 A * 10/1926 Miller ..... A44C 7/00 63/14.2
2,525,195 A * 10/1950 Austrin ..... A44C 19/00 D11/69
2,914,928 A * 12/1959 Warden ..... A44C 7/009 63/29.1
4,827,738 A * 5/1989 Rothal ..... A44C 7/009 D11/42
4,993,240 A * 2/1991 Pounder ..... A44C 7/009 63/14.7
5,809,803 A * 9/1998 Stracuzzi ..... A44C 7/009 63/12
D533,803 S 12/2006 Corso
2010/0212356 A1 8/2010 Namiki

FOREIGN PATENT DOCUMENTS

DE 20 2008 014316 2/2009
DE 102016117640 B4 * 7/2018 ..... A44C 7/00
EP 2220957 A1 * 8/2010 ..... A44C 7/002
JP 3146204 11/2008

* cited by examiner

*Primary Examiner* — Jack W Lavinder
(74) *Attorney, Agent, or Firm* — Salter & Michaelson

(57) ABSTRACT

A decorative earring structure in the form of an elongated wire piece having contiguous wire piece sections including at least a proximal top wire piece section that is in the form of a wire piece arcuate loop that is constructed and arranged to extend over, about and behind the ear of a wearer, and a distal turned wire piece section that is constructed and arranged for positioning behind the ear lobe. A support receptacle is disposed at a free end of the distal turned wire piece and disposed at a back side of the ear lobe, and a support post is disposed at a front side of the ear lobe, engageable with the support receptacle and for retaining the decorative earring structure in place.

19 Claims, 12 Drawing Sheets

EARRING BACK SUPPORTER WITH ADDITIONAL ORNAMENT

RELATED CASES

Priority for this application is hereby claimed under 35 U.S.C. § 119(e) to commonly owned and U.S. Provisional Patent Application No. 63/207,322 which was filed on Feb. 23, 2021 and which is incorporated by reference herein in its entirety.

FIELD OF THE INVENTION

The present invention relates to a decorative earring, and particularly to a decorative earring structure that enables a wide variety of display options.

BACKGROUND OF THE INVENTION

Existing earrings are for the most part supported at a pierced hole in the lobe of the user's ear. The amount and size of decorative items that can be supported is somewhat limited so that damage does not occur to the ear lobe.

Accordingly, it is an object of the present invention to provide an improved decorative earring structure in which there is, not only support at the ear lobe, but support by means of an elongated wire piece from a top portion of the outer ear.

Another object of the present invention is to provide an improved decorative earring structure that enables decorative items to be supported both at the ear lobe as well as at a front top portion of the outer ear.

SUMMARY OF THE INVENTION

To accomplish the foregoing and other objects of the present invention there is provided a decorative earring structure in the form of an elongated wire piece having contiguous wire piece sections including at least a proximal top wire piece section that is in the form of a wire piece arcuate loop that is constructed and arranged to extend over, about and behind the ear of a wearer, and a distal turned wire piece section that is constructed and arranged for positioning behind the ear lobe, a support receptacle that is disposed at a free end of the distal turned wire piece and disposed at a back side of the ear lobe, and a support post disposed at a front side of the ear lobe; engageable with the support receptacle and for retaining the decorative earring structure in place.

In accordance with other aspects of the present invention the support post includes a decorative item; the decorative item is spherical; the decorative item includes a series of separate decorative items that fall under gravity from the support post; the proximal top wire section has a free end that extends toward the back of the ear; the support post includes a first decorative item, and the free end of proximal top wire section supports a second decorative item; the elongated wire piece also includes a contiguous intermediate wire piece section that transitions between the proximal top wire piece section and the distal turned wire piece section; the elongated wire piece also includes a contiguous intermediate wire piece section that transitions between the proximal top wire piece section and the distal turned wire piece section; the intermediate wire piece section is defined by a reverse curve forming with the proximal top wire piece section a question mark shape; and wherein the elongated wire piece is constructed of a pliable plastic piece that has limited stretchability.

In accordance with another version of the present invention there is provided a decorative earring structure in the form of an elongated wire piece having contiguous wire piece sections including at least a proximal top wire piece section that is in the form of a wire piece arcuate loop that is constructed and arranged to extend over, about and behind the ear of a wearer, and a distal turned wire piece section that is constructed and arranged for positioning behind the ear lobe, a combination post and backing that is disposed at a free end of the distal turned wire piece and disposed about the ear lobe for retaining the decorative earring structure in place supported from the ear lobe, and further including a first decorative item supported at the combination post and backing, and a second decorative item supported at a free end of proximal top wire section.

In accordance with still other aspects of the present invention the combination post and backing is comprised of a support receptacle that is disposed at a free end of the distal turned wire piece and disposed at a back side of the ear lobe, and a support post disposed at a front side of the ear lobe, engageable with the support receptacle and for retaining the decorative earring structure in place; the first decorative item is spherical; the first decorative item includes a series of separate decorative items that fall under gravity from the support post; the elongated wire piece also includes a contiguous intermediate wire piece section that transitions between the proximal top wire piece section and the distal turned wire piece section; the intermediate wire piece section is defined by a reverse curve forming with the proximal top wire piece section a question mark shape; and wherein the elongated wire piece is constructed of a pliable plastic piece that has limited stretchability.

In accordance with the present invention there is also provided a method of mounting a decorative earring structure about a wearers ear comprising providing an elongated wire piece having contiguous wire piece sections including at least a proximal top wire piece section that is in the form of a wire piece arcuate loop, arranging the wire piece arcuate loop to extend over, about and behind the ear of the wearer, and a distal turned wire piece section that is constructed and arranged for positioning behind the ear lobe, and providing a combination post and backing that is disposed at a free end of the distal turned wire piece and disposed about the ear lobe for retaining the decorative earring structure in place supported from the ear lobe.

In accordance with other aspects of the present invention including providing a contiguous intermediate wire piece section that transitions between the proximal top wire piece section and the distal turned wire piece section, wherein the intermediate wire piece section is defined by a reverse curve forming with the proximal top wire piece section a question mark shape; and including providing a first decorative item supported at the combination post and backing, and a second decorative item supported at a free end of proximal top wire section.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 18:
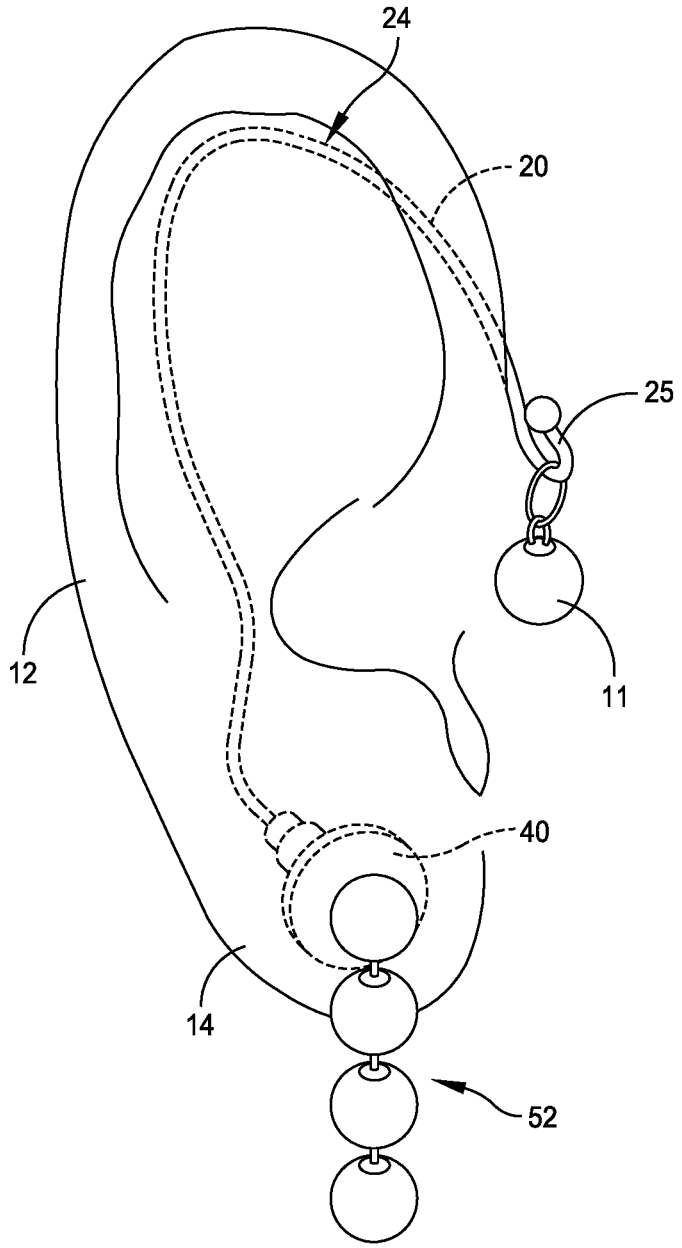
FIG. 18 illustrates the position of both the upper and lower decorative item.

One of the unique features of the decorative earring structure of the present invention is to provide a support for not only a lower decorative item 52 but also an upper decorative item 11. Because the lower decorative item is generally supported at a hole in the ear lobe, one is limited in the amount of weight that can be carried by the lower decorative item. This in turn limits the selection of a decorative item. The support is supplemented by means of elongated wire piece 20. Refer, for example, to FIG. 18. It is noted that the elongated wire piece 20 extends over the top of the outer ear 12. The contact of the wire piece approximately at the location 21 in FIG. 18 provides additional support to supplement the support provided at the ear lobe. The arrangement of the present invention enables one to provide many jewelry ornaments that can, not only be supported at the ear lobe, but can also hang over the front of the ear adding more jewelry to adorn the ear. The elongated wire piece 20 is preferably formed to the front of the ear and terminates at a lower location at the pierced hole in the ear lobe. The combination of the support at 21 in FIG. 18 as well as the support at the ear lobe prevents the stretching of the hole and a tearing of the ear lobe.

The elongated wire piece 20 is preferably formed in a fixed position so as to extend about the outer ear. The elongated wire piece 20 may be constructed of a metal wire or virtually any other elongated piece that can assume and stay in a relatively fixed position. In addition to constructing the elongated wire piece of a metal material it can also be constructed, for example, of a silicone material.

With further reference to the drawings, there is provided a decorative earring structure 10 in the form of an elongated wire piece 20 having contiguous wire piece sections including at least a proximal top wire piece section 22. This proximal top wire piece section is preferably in the form of a wire piece arcuate loop 24. This loop is constructed and arranged to extend over, about and behind the ear of a wearer.

The elongated wire piece 20 also has a distal turned wire piece section 26 that is constructed and arranged for positioning behind the ear lobe at the back side 16. In this regard refer to FIG. 7.

The decorative earring structure is also comprised of a support receptacle 40 that is disposed at a free end of the distal turned wire piece. The support receptacle is disposed at a back side 16 of the ear lobe.

Figure 8:
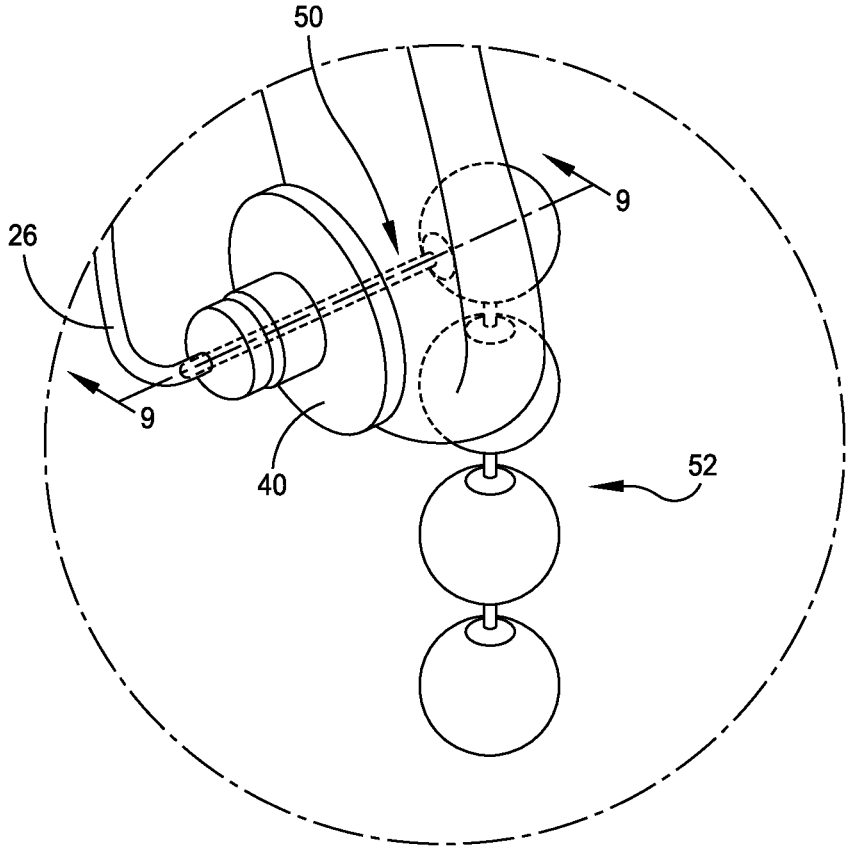
FIG. 8 is an enlarged fragmentary view from FIG. 7.
Figure 9:
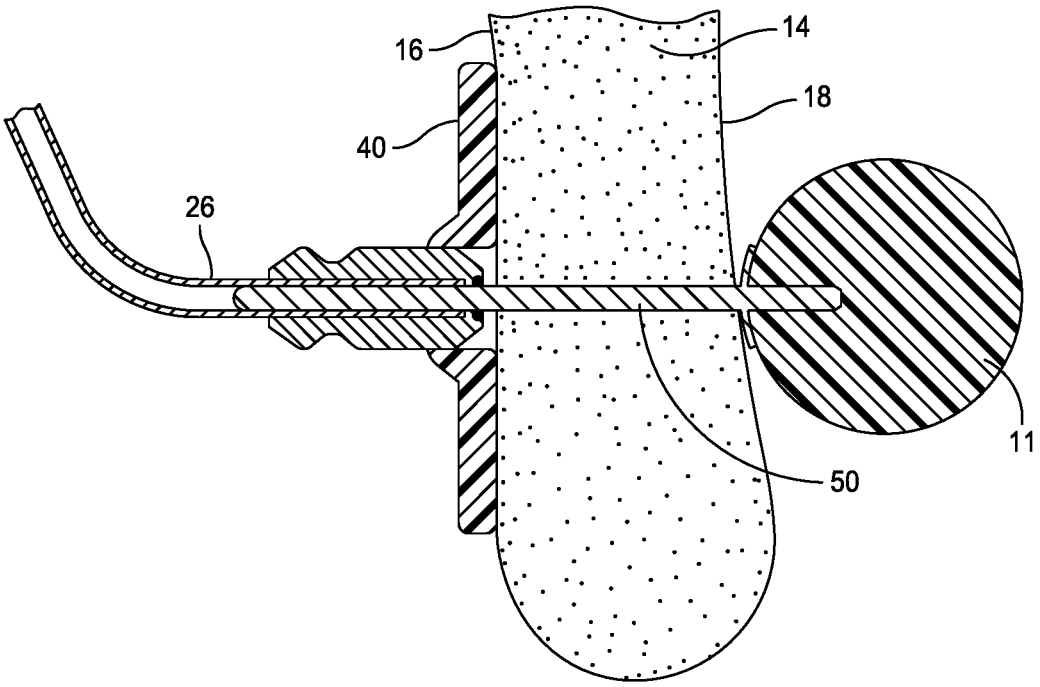
FIG. 9 is a cross-sectional view taken along line 9-9 of FIG. 8.
Figure 10:
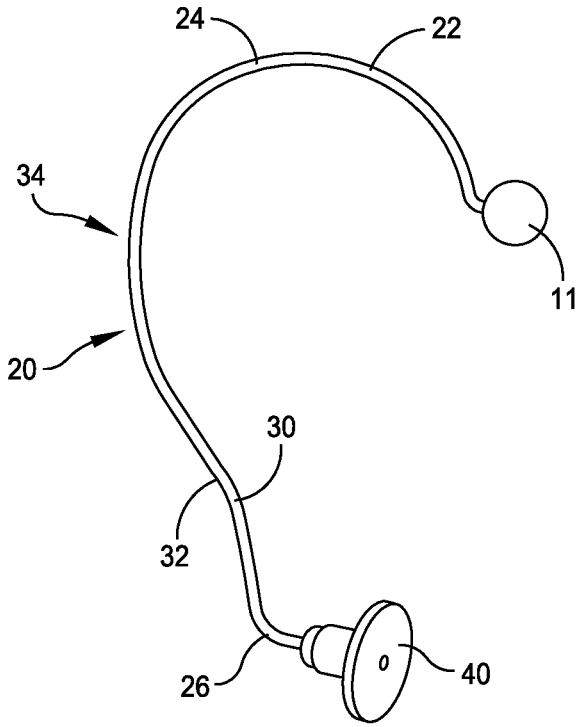
FIG. 10 is a front view of the decorative earring structure.
Figure 11:
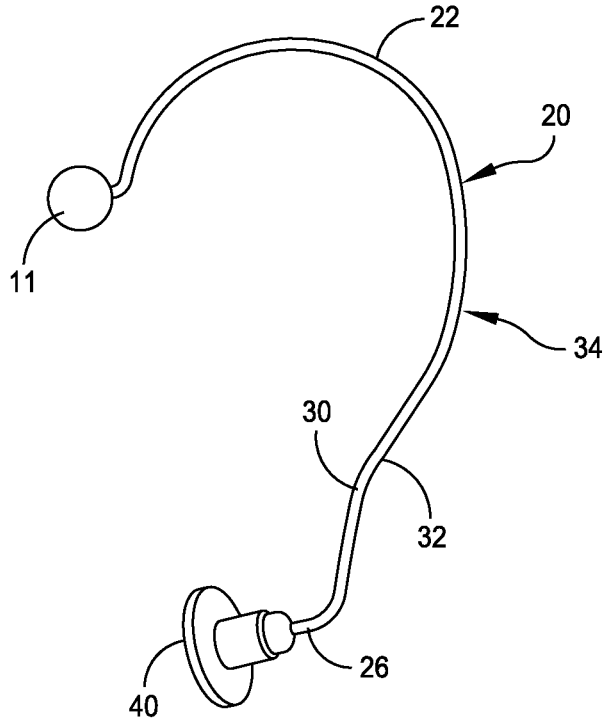
FIG. 11 is a rear view of the decorative earring structure.
Figure 12:
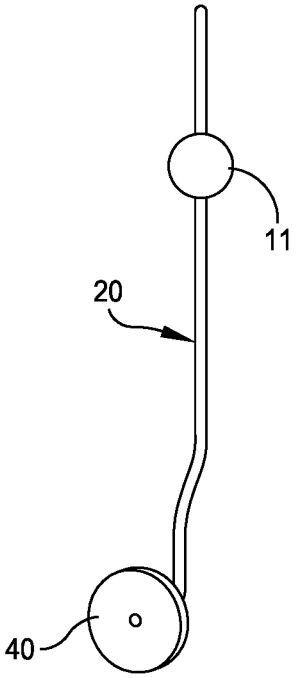
FIG. 12 is a left side view of the decorative earring structure.
Figure 13:
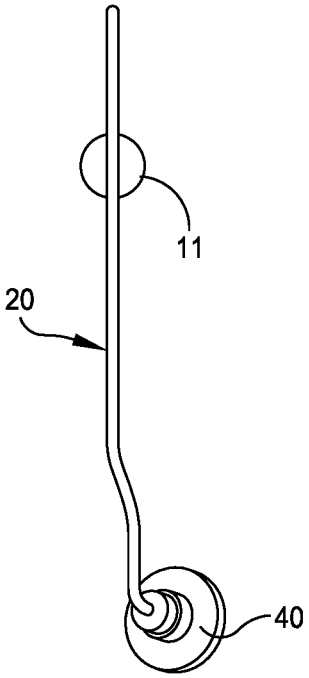
FIG. 13 is a right side view of the decorative earring structure.
Figure 14:
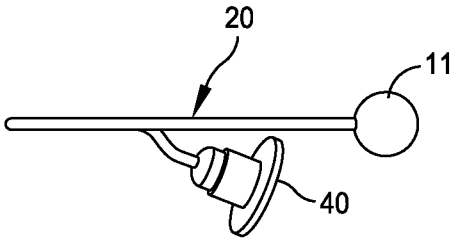
FIG. 14 is a top view of the decorative earring structure.
Figure 15:
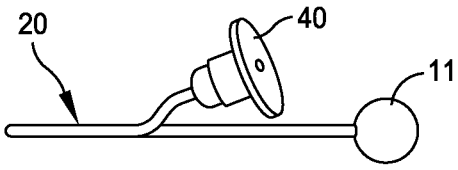
FIG. 15 is a bottom view of the decorative earring structure.

The decorative earring structure is also comprised of a support post 50 disposed at the front side 18 of the ear lobe. The support post is meant to be engageable with the support receptacle for retaining the decorative earring structure in place. In this regard refer to the cross-sectional view of FIG. 9 that illustrates the receptacle at 40 and the support post at 50. The support post engages with the upper decorative item. In FIG. 9 only a single pearl is illustrated for item 11 whereas in FIG. 8 a series of pearls or the like comprise the complete decorative item. It is also noted that the elongated wire piece is hollow so as to receive the pin 50, in another embodiment of the present invention, the elongated wire piece may be solid for a substantial length but be hollow at the end as in FIG. 9 where the support post engages with, not only the receptacle 40 but also the distal turned wire piece section 26.

Figure 1:
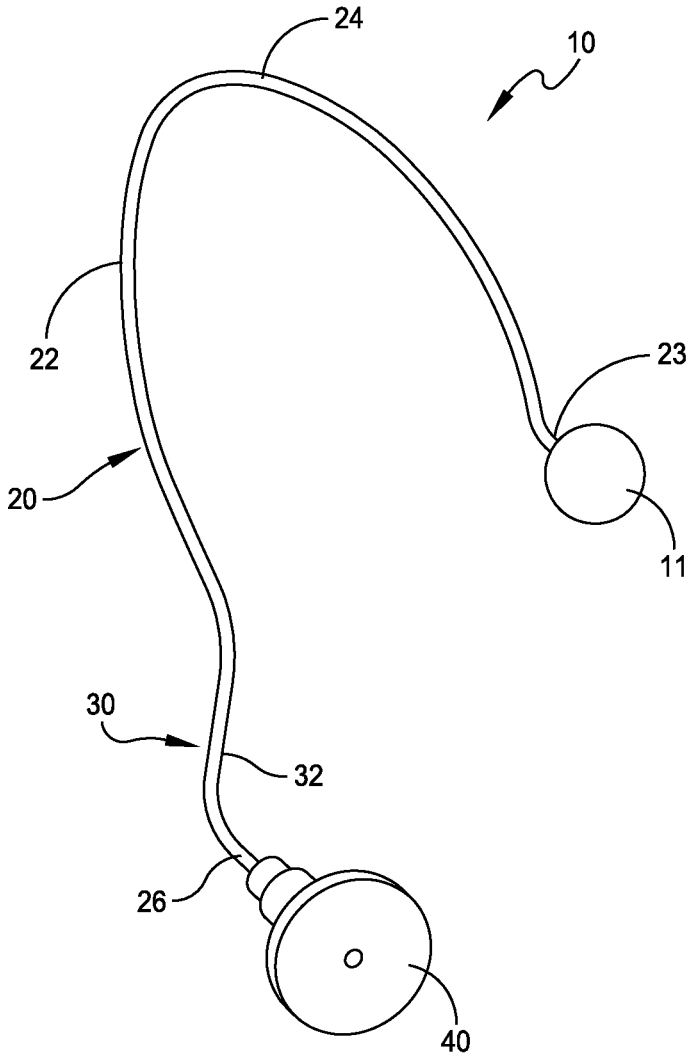
FIG. 1 is a perspective view of one embodiment of the decorative earring structure of the present invention.
Figure 2:
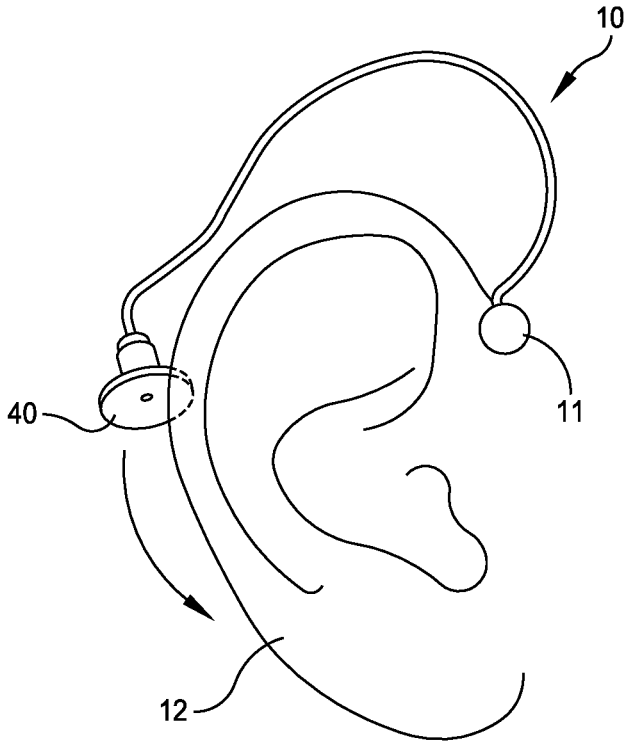
FIG. 2 is a side elevation view showing the manner in which the decorative earring structure is initially placed about the top of the outer ear.
Figure 3:
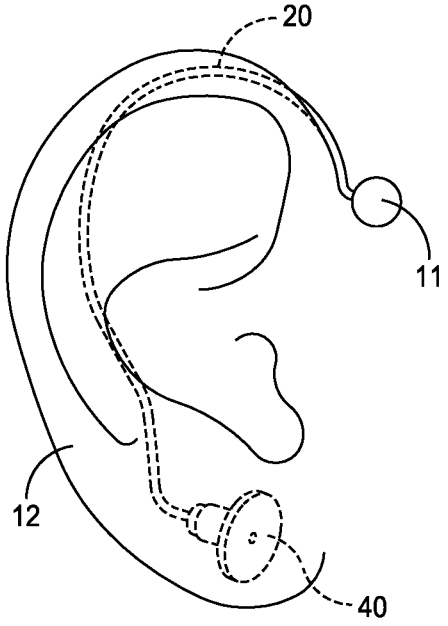
FIG. 3 is a view similar to that shown in FIG. 2 but also illustrating the final position of the earring structure.
Figure 4:
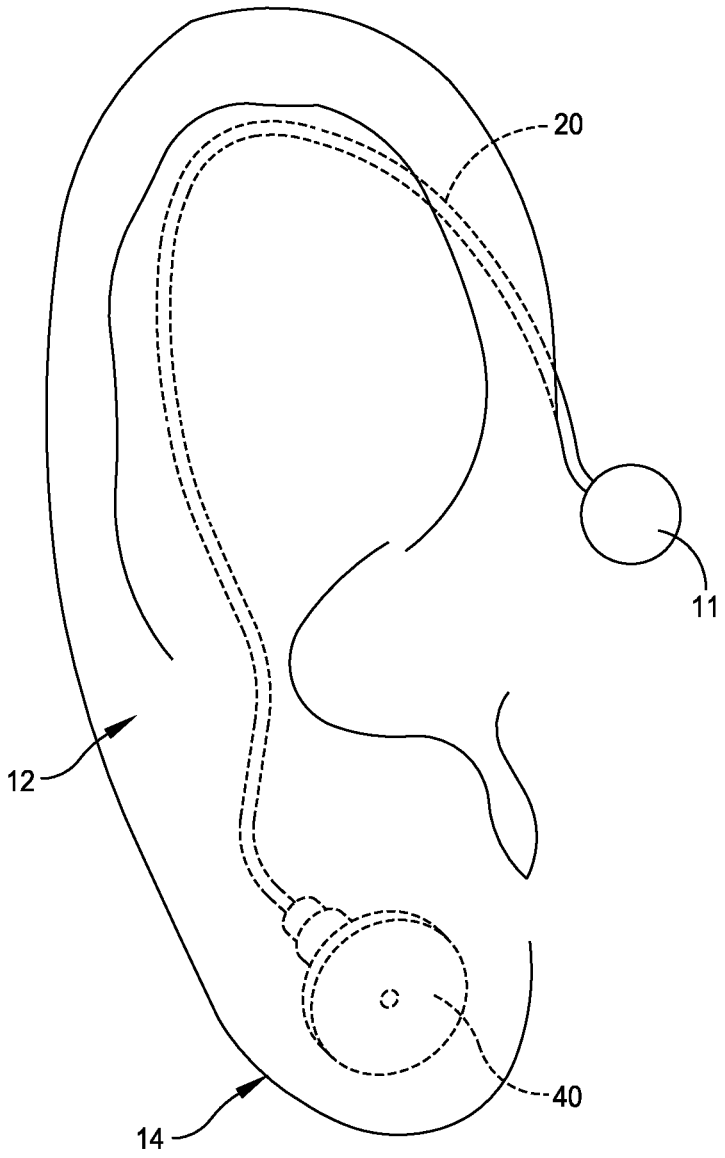
FIG. 4 is a perspective view of the earring structure in place.
Figure 5:
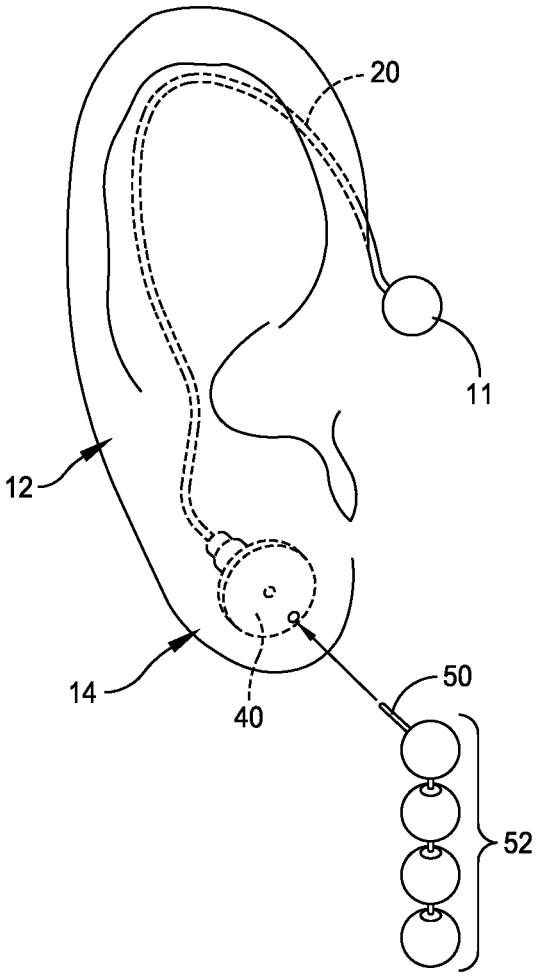
FIG. 5 is a perspective view illustrating the attachment of the lower decorative item.
Figure 6:
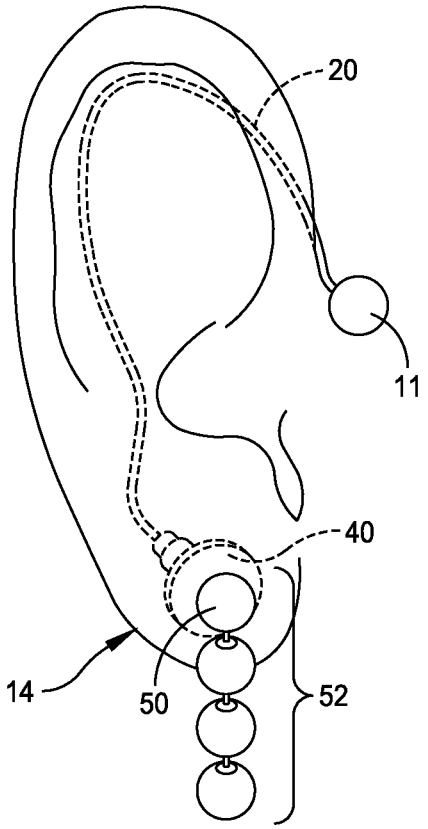
FIG. 6 is a perspective view showing the lower decorative item attached.
Figure 7:
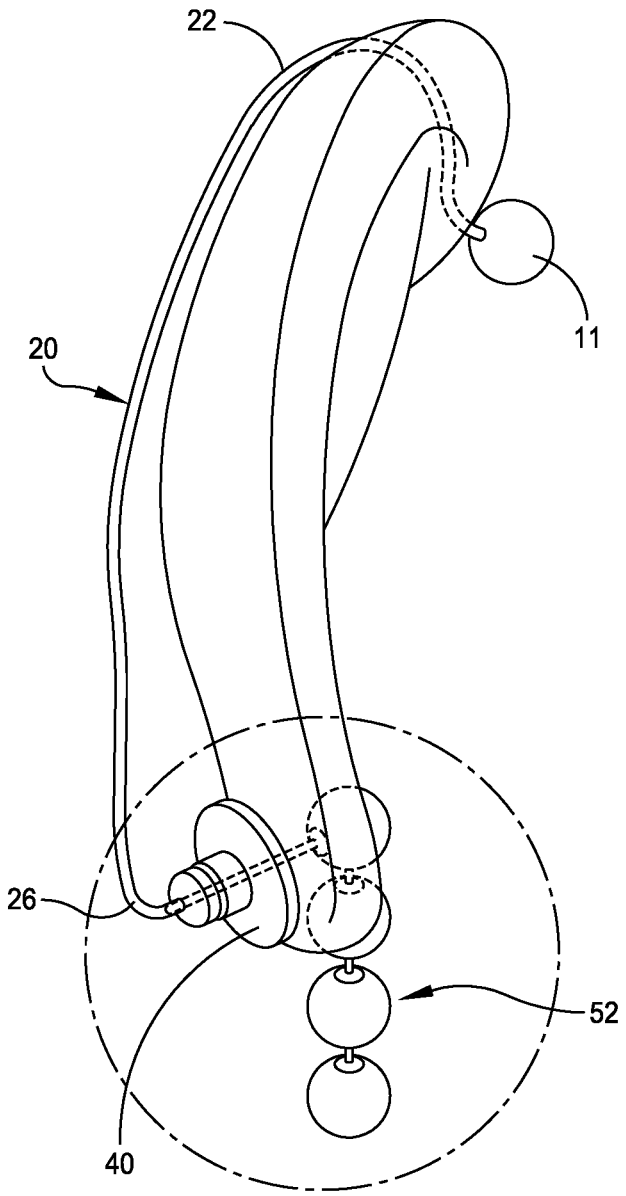
FIG. 7 is a more rearward view illustrating the attachment of the lower decorative item.

As illustrated in the drawings herein, the lower decorative piece 11 may be in the form of a pearl or any other decorative item and is illustrated herein, such as in FIG. 7 as comprised of a series of separate spheres, pearls, or items that basically extend downwardly with gravity from the support post. The proximal top wire section has a free end that extends towards the back of the ear. The ear support post includes a lower decorative item 52 and the free end of the proximal top wire section 22 that supports the upper decorative item 11.

The elongated wire piece may also be considered as including a contiguous intermediate wire piece section that transitions between the proximal top wire piece section and the distal turned wire piece section. The intermediate wire piece section 30 is defined by a reverse curve 32 forming with the proximal top wire piece section 22 a question mark shape 34.

In accordance with another aspect of the present invention, at the lower end of the elongated wire piece 20, there may be provided a combination post and backing that is disposed at a free end of the distal turned wire piece. In this regard, a first decorative item is supported at the combination post and backing, and a second decorative item is supported at a free end of the proximal top wire piece section.

Figure 16:
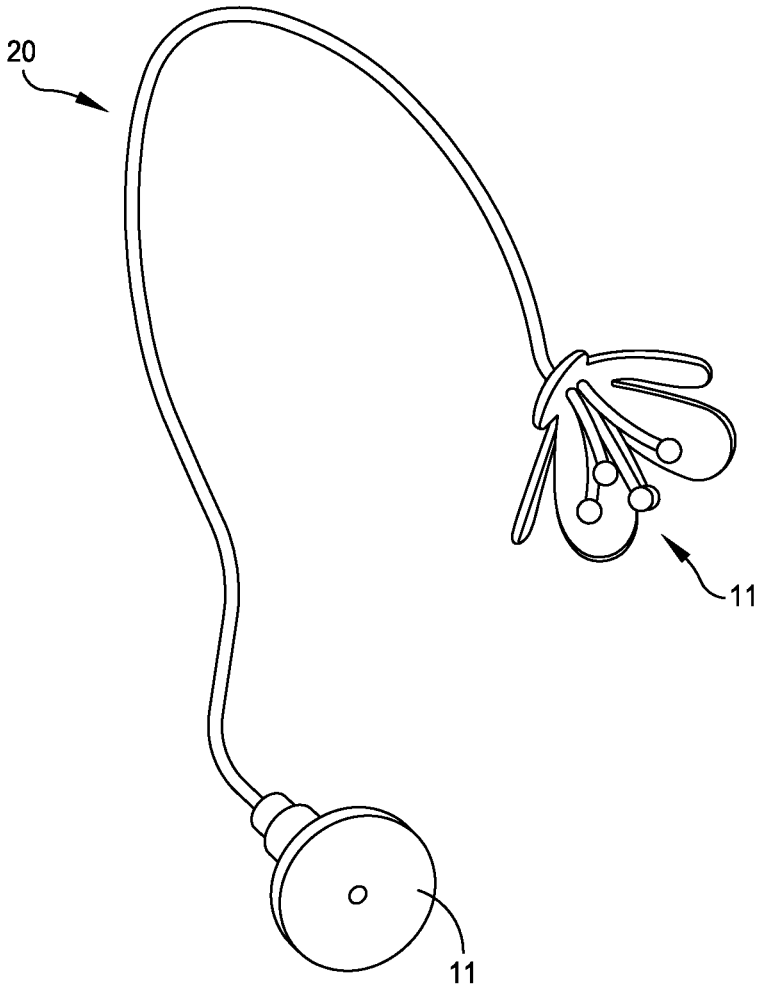
FIG. 16 is a perspective view similar to that shown in FIG. 1 but further illustrating another form of an upper decorative item in the form of a flower.
Figure 17:
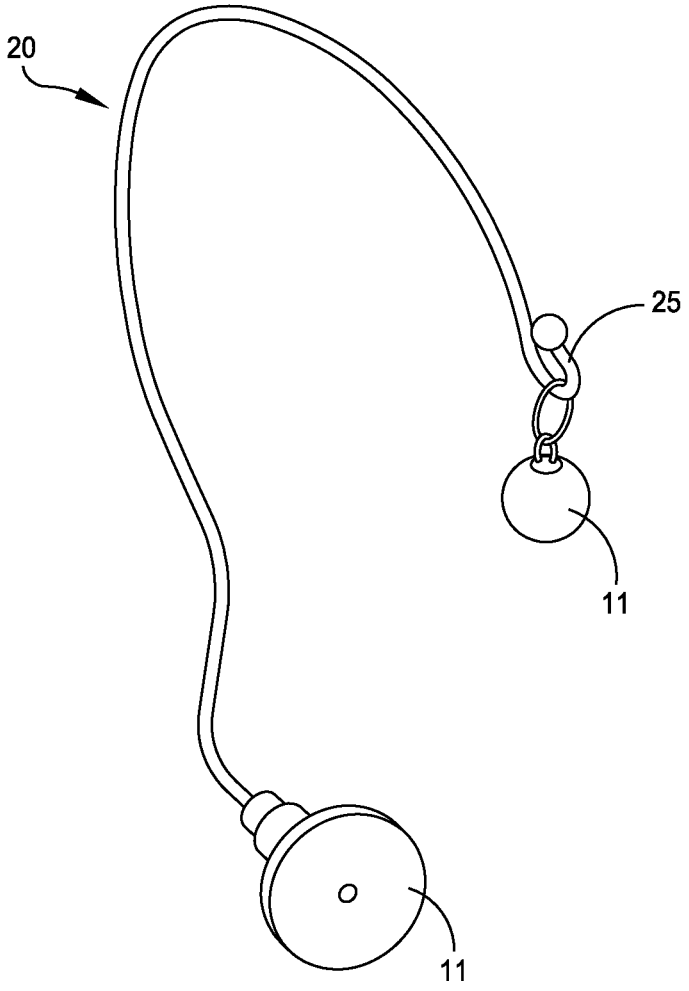
FIG. 17 is a perspective view similar to that shown in FIG. 1 but illustrating a variation where the upper decorative item is supported in a different manner.
Figure 19:
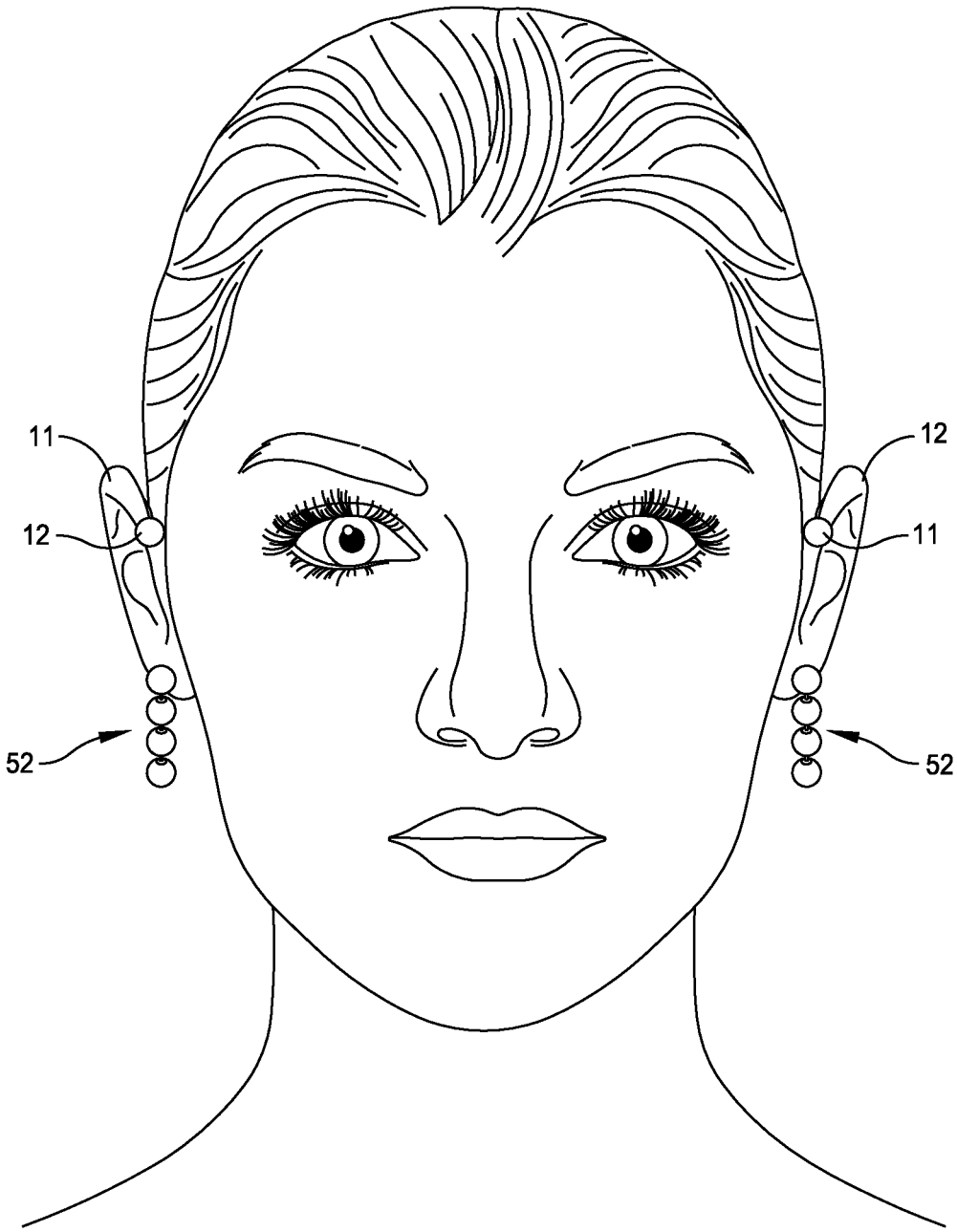
FIG. 19 is a frontal view where one can observe the general location of both the upper and lower decorative items.

In FIGS. 1-15 the upper decorative item 11 has been illustrated, for simplicity, as simply a spherical member which could be a pearl. Reference may also be made to the perspective view of FIG. 16 that illustrates the upper decorative item at 11 in the form of a flower or virtually any other appealing decorative item. Reference is also now made to FIGS. 17 and 18 that illustrate the top of the elongated wire piece as having a loop 25 for retaining the upper decorative item. The loop 25 may be constructed so that various forms of decorative items can be attached at that location. FIG. 19 is a frontal view illustrating the manner in which both upper and lower decorative items can be supported at both ears. Thus, the particular question mark shape of the elongated wire piece 20 provides support for an upper decorative item while at the same time also enhancing support for the lower decorative item 52; alleviating strain on the ear lobe.

REFERENCE NUMBERS decorative earring structure 10
upper decorative item 11
outer ear 12
ear lobe 14
ear lobe front side 18
ear lobe back side 16
ear lobe pierced hale 19
elongated wire piece 20
outer ear upper location 21
proximal top wire piece section 22
free end of the proximal top wire piece section 23
wire piece arcuate loop 24
proximal tope wire piece section loop 25
distal turned wire piece section 26
free end of the distal turned wire piece section 27
contiguous intermediate wire piece section 30
wire piece reverse curve 32
question mark shape 34
support receptacle (backing) 40
support post 50
lower decorative item 52

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A decorative caning structure in the form of an elongated wire piece having contiguous wire piece sections including at least a proximal top wire piece section that is in the form of a wire piece arcuate loop that is constructed and arranged to extend over, about and behind the ear of a wearer, and a distal turned wire piece section that is constructed and arranged for positioning behind the ear lobe, a support receptacle that is disposed at a free end of the distal turned wire piece and disposed at a back side of the ear lobe, and a support post disposed at a front side of the ear lobe, engageable with the support receptacle and for retaining the decorative earring structure in place, the free end of the distal turned wire piece being hollow so as to receive the support post.

2. The decorative earring structure of claim 1 wherein the support post is for mounting a lower decorative item that is disposed adjacent to an ear lobe front side.

3. The decorative earring structure of claim 2 wherein the support receptacle has a passage for receiving the free end of the distal turned wire piece while the support post engages with the free end of the distal turned wire piece.

4. The decorative earring structure of claim 2 wherein the decorative item includes a series of separate decorative items that fall under gravity from the support post.

5. The decorative earring structure of claim 1 wherein the proximal top wire section has a free end that extends toward the front of the ear.

6. The decorative earring structure of claim 5 wherein the support post includes a first lower decorative item, and the free end of proximal top wire section supports a upper decorative item.

7. The decorative earring structure of claim 6 wherein the elongated wire piece also includes a contiguous intermediate wire piece section that transitions between the proximal top wire piece section and the distal turned wire piece section.

8. The decorative earring structure of claim 1 wherein the elongated wire piece also includes a contiguous intermediate wire piece section that transitions between the proximal top wire piece section and the distal turned wire piece section, wherein the support receptacle has a passage for receiving the free end of the distal turned wire piece while the support post engages with the free end of the distal turned wire piece, wherein the support receptacle includes a support disc that is disposed against a back side of the ear lobe, and wherein the support receptacle further includes a supported with the support disc and that has the passage formed therein for receiving the free end of the distal turned wire piece.

9. The decorative earring structure of claim 8 wherein the intermediate wire piece section is defined by a reverse curve forming with the proximal top wire piece section a question mark shape.

10. The decorative earring structure of claim 1 wherein the elongated wire piece is constructed of a pliable plastic piece that has limited stretchability.

11. The decorative earring structure of claim 1 wherein the elongated wire piece also includes a contiguous intermediate wire piece section that transitions between the proximal top wire piece section and the distal turned wire piece section.

12. The decorative earring structure of claim 11 wherein the intermediate wire piece section is defined by a reverse curve forming with the proximal top wire piece section a question mark shape.

13. The decorative earring structure of claim 1 wherein the support post is for mounting a lower decorative item that is disposed adjacent to an ear lobe front side, wherein the free end of the distal turned wire piece is hollow including an elongated passage so as to receive the support post, wherein the support receptacle includes a planar support disc that is disposed against a back side of the ear lobe, and wherein the distal turned wire piece has a free end that extends orthogonal to the planar support disc.

14. A decorative earring structure in the form of an elongated wire piece having contiguous wire piece sections including at least a proximal top wire piece section that is in the form of a wire piece arcuate loop that is constructed and arranged to extend over, about and behind the ear of a wearer, and a distal turned wire piece section that is constructed and arranged for positioning behind the ear lobe, a combination post and backing that is disposed at a free end of the distal turned wire piece and disposed about the ear lobe for retaining the decorative earring structure in place supported from the ear lobe, and further including a first lower decorative item supported at the combination post and backing, and an upper decorative item supported at a free end of proximal top wire section, wherein the backing comPrises a support receptacle including a planar support disc that is disposed against a back side of the ear lobe, wherein the distal turned wire piece has a free end that extends orthogonal to the planar support disc and engages with the bucking.

15. The decorative earring structure of claim 14 wherein the combination post and backing is comprised of a support post disposed at a front side of the ear lobe, engageable with the support receptacle and for retaining the decorative earring structure in place.

16. The decorative earring structure of claim 15 wherein the first elongated wire piece also includes a contiguous intermediate wire piece section that transitions between the proximal top wire piece section and the distal turned wire piece section.

17. The decorative earring structure of claim 16 wherein the free end of the distal turned wire piece is hollow so as to receive the support post, wherein the support receptacle has a passage for receiving the free end of the distal turned wire piece while the support post engages with the free end of the distal turned wire piece while the support post engages with the free end of the distal turned wire piece, and wherein the support receptacle further includes a pin supported with the support disc and that had the passage formed therein for receiving the free end of the distal turned wire piece.

18. The decorative earring structure of claim 14 wherein the elongated wire piece is constructed of a pliable plastic piece that has limited stretchability.

19. The decorative earring structure of claim 14 wherein the support post is for mounting a lower decorative item that is disposed adjacent to an ear lobe front side, wherein the free end of the distal turned wire piece is hollow including an elongated passage so as to receive the support post, wherein the support receptacle includes a planar support disc that is disposed against a hack side of the ear lobe, and wherein the distal turned wire piece has a free end that extends orthogonal to the planar support disc.

* * * * *